US006163917A

United States Patent [19]

Bown

[11] Patent Number: 6,163,917

[45] Date of Patent: Dec. 26, 2000

[54] ROTATING BRUSH FOR SURFACE TREATMENT OF WORKING PIECES

[75] Inventor: Damian Bown, Chepstow, United Kingdom

[73] Assignee: Brushes International Limited, Gwent, United Kingdom

[21] Appl. No.: 09/077,612

[22] PCT Filed: Sep. 30, 1997

[86] PCT No.: PCT/EP97/05367

§ 371 Date: Mar. 26, 1999

§ 102(e) Date: Mar. 26, 1999

[87] PCT Pub. No.: WO98/14089

PCT Pub. Date: Apr. 9, 1998

[30] Foreign Application Priority Data

Oct. 2, 1996 [DE] Germany ..... 296 17 206

[51] Int. Cl.[7] ..... A46B 3/08

[52] U.S. Cl. ..... 15/179; 451/507

[58] Field of Search ..... 15/179, 180, 230, 15/181, 49.1, 50.3; 451/342, 353, 508, 514, 515, 466, 360, 507, 512

[56] References Cited

U.S. PATENT DOCUMENTS

| | | |
|---|---|---|
| 260,336 | 6/1882 | Thayer . |
| 680,418 | 8/1901 | Ross . |
| 2,136,103 | 11/1938 | Herold . |
| 2,658,802 | 11/1953 | Stahel . |

FOREIGN PATENT DOCUMENTS

| | | |
|---|---|---|
| 522 560 | 8/1921 | France . |
| 532 243 | 1/1922 | France . |
| 1 332 720 | 12/1963 | France . |
| 295 13 247 U | 10/1995 | Germany . |
| 368125 | 2/1939 | Italy ..... 15/179 |

*Primary Examiner*—Gary K. Graham

*Attorney, Agent, or Firm*—Lowe Hauptman Gopstein Gilman & Berner

[57] ABSTRACT

Disclosed is a rotating brush for surface treatment of working pieces. The rotating brush includes a brush fitting clamped between two clamping disks. The brush is so designed that the two clamping disks present on their opposing sides an axial shoulder of such inside and outside diameters that, when the disks are secured to each other, the axial shoulders of the one engages into that of the other to form an assembly, thereby forming a cylindrical holding element in which the brush fitting is inserted.

14 Claims, 3 Drawing Sheets

ROTATING BRUSH FOR SURFACE TREATMENT OF WORKING PIECES

FIELD OF THE INVENTION

This invention relates to a rotary brush for surface treatment of workpieces and more particularly to such a brush including a fitting or clamping joint between a pair of axial collars, at least one of which has axial ribs on its circumference.

BACKGROUND ART

Known rotating circular brushes are usually produced by disposing the brush fitting, which includes for example one or more disk-like brush elements, between a plurality of pressed metal parts. This construction has hitherto been used by all brush manufacturers and is still applied today in a great number of similar forms.

In contrast, DE-U 295 13247.7 discloses a rotary brush of the generic kind wherein the brush fitting is clamped between two interconnected clamping disks and thereby mounted on an essentially cylindrical holding element formed by said clamping disks.

Although this known rotary brush has proven very advantageous, it has turned out that there is still a need for simplified production of the brush and an essential reduction of material costs.

The invention is therefore based on the problem of designing the brush of the generic kind so as to simplify production while achieving a considerable reduction of material costs and simultaneously a lower weight involving further handling advantages.

The features of the invention solving this problem can be found in claim 1. Advantageous embodiments are described in the further claims.

SUMMARY OF THE INVENTION

The inventive rotary brush is designed such that the clamping disks each have on their mutually facing side an axial collar whose outside or inside diameter is such that when the clamping disks are fastened together the axial collar of one clamping disk engages that of the other clamping disk in connecting fashion so as to form the clamping disk connection and this simultaneously forms the cylindrical holding element for mounting the brush fitting.

This design is based on the essential inventive idea of not providing the axial collars of the two clamping disks only for mounting the brush fitting, but designing them so that they fix the two clamping disks together themselves. This can be easily obtained with simple production techniques so as to ensure a simple and reliable connection of the clamping disks.

In one embodiment of the invention, the axial collars of the two clamping disks have the same length, while in a second embodiment the collars have different lengths.

The engaging connection between the axial collars of the two clamping disks includes a fitting or clamping joint. The fitting or clamping joint between the axial collars is formed by at Least one of the collars having elevations, in particular in the form of axial ribs, on its circumferential surface cooperating with the other collar.

When the two clamping disks are pressed together, which is done using a 20 ton press for example, these elevations are connected effectively with the associated circumferential surface of the other collar by the action of force, thereby achieving the desired reliable connection between the clamping disks. In one embodiment, the engaging connection between the axial collars of the two clamping disks is formed or secured by adhesive applied to at least one of the cooperating circumferential surfaces of the axial collars.

In an expedient embodiment of the inventive rotary brush, the axial ribs are provided on the outside circumferential surface of the smaller-diameter axial collar. Two axial ribs are advantageously present in each case. However, it is within the scope of the invention to provide three, four or more axial ribs instead.

It is advantageous for the axial ribs to be spaced the same circumferential distance apart, since this also achieves a uniform clamping effect over the circumference of the axial collars.

In order to facilitate the joining of the two clamping disks by the action of high force in the initial stage, the axial ribs are preferably beveled on their front free faces.

Accordingly, it is also within the scope of the invention for the axial collar receiving the axial ribs to be beveled on its front face.

Unless the two clamping disks are intended to be detached from each other at a later time for some reason, an advantageous embodiment of the invention is for the axial collar receiving the axial ribs to bear at its front end a torus which grasps behind the axial ribs formed with predetermined length of the other axial collar in securing fashion when the clamping disks are fixed together.

To mount the brush fitting in nonslip fashion on the cylindrical holding element formed by the two clamping disks, the greater-diameter axial collar expediently bears axially extending longitudinal ribs on its outside circumferential surface.

It is advantageous for the clamping disks to be made of glass fiber reinforced plastic. It is thereby within the scope of the invention for the clamping disks to be injection molded parts.

Altogether the inventive rotary brush can achieve essential advantages, including:

less labor for producing the brush, considerable reduction of material costs, simpler mounting equipment, improved possibility of assembling the brush, lower weight, better suitability for automatic production, etc.

The invention will be explained more closely in the following with reference to the drawings.

DETAILED DESCRIPTION OF THE DRAWING

Figure 1:
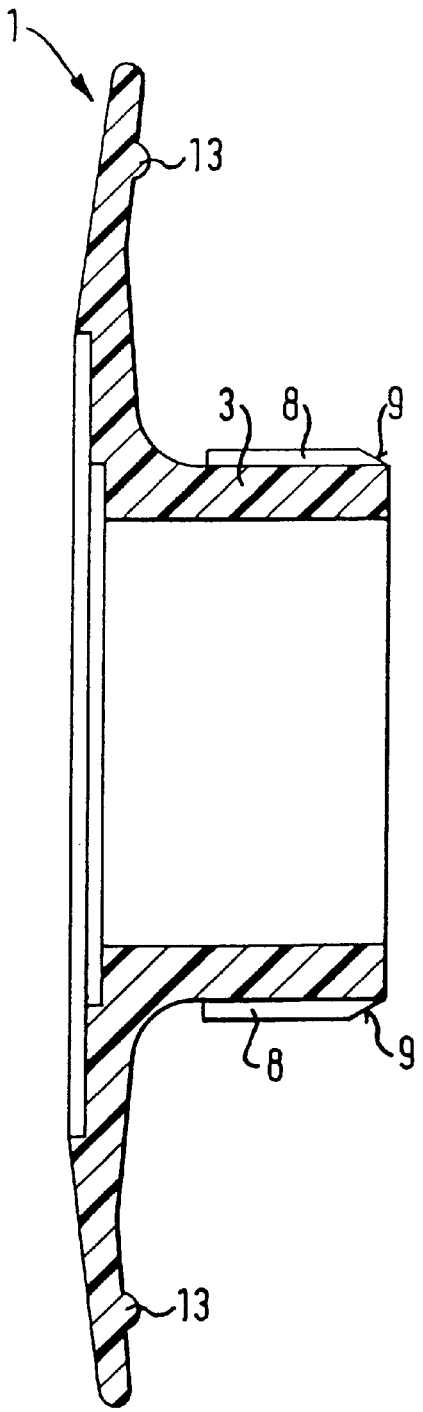
FIG. 1 cross sectional view of one clamping disk of the inventive rotary brush.
Figure 2:
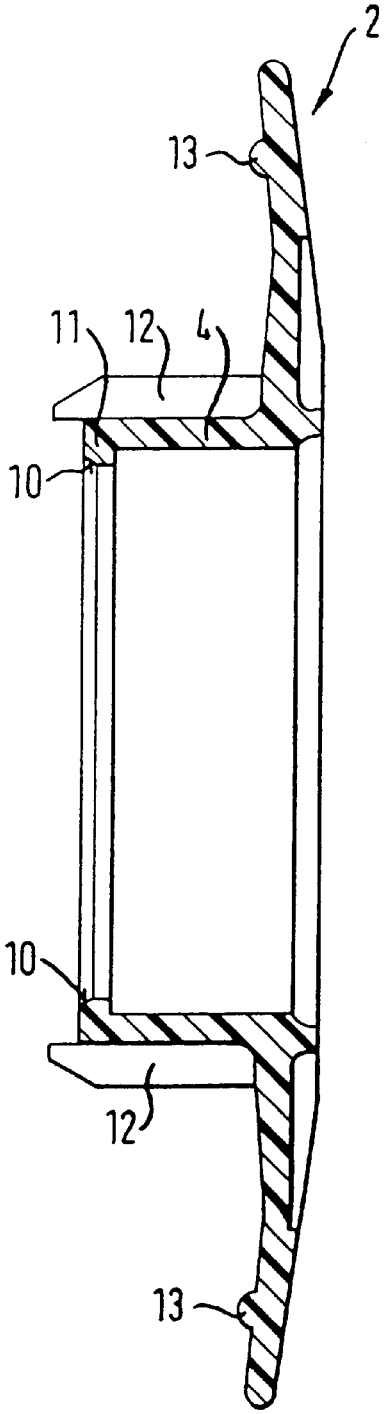
FIG. 2 is a cross sectional view of the other clamping disk of the rotary brush.

As evident from the drawing, in particular FIGS. 1 and 2, the rotary brush provided for surface treatment of workpieces has two clamping disks 1, 2 which are designed differently in the shown embodiment but can also have the same design.

As indicated clearly by FIGS. 1 and 2, clamping disks 1, 2 each have on their mutually facing side axial collars 3, 4. Its outside or inside diameter is such that when clamping disks 1, 2 are fastened together according to FIG. 3 axial collar 3 of clamping disk 1 engages axial collar 4 of clamping disk 2 in connecting fashion so as to form the clamping disk connection. This simultaneously forms a cylindrical holding element for mounting brush fitting 5 (see FIG. 3). This fitting is designed in the usual way with wire bristles 7 held in clamping elements 6 of U-shaped cross section.

Figure 4:
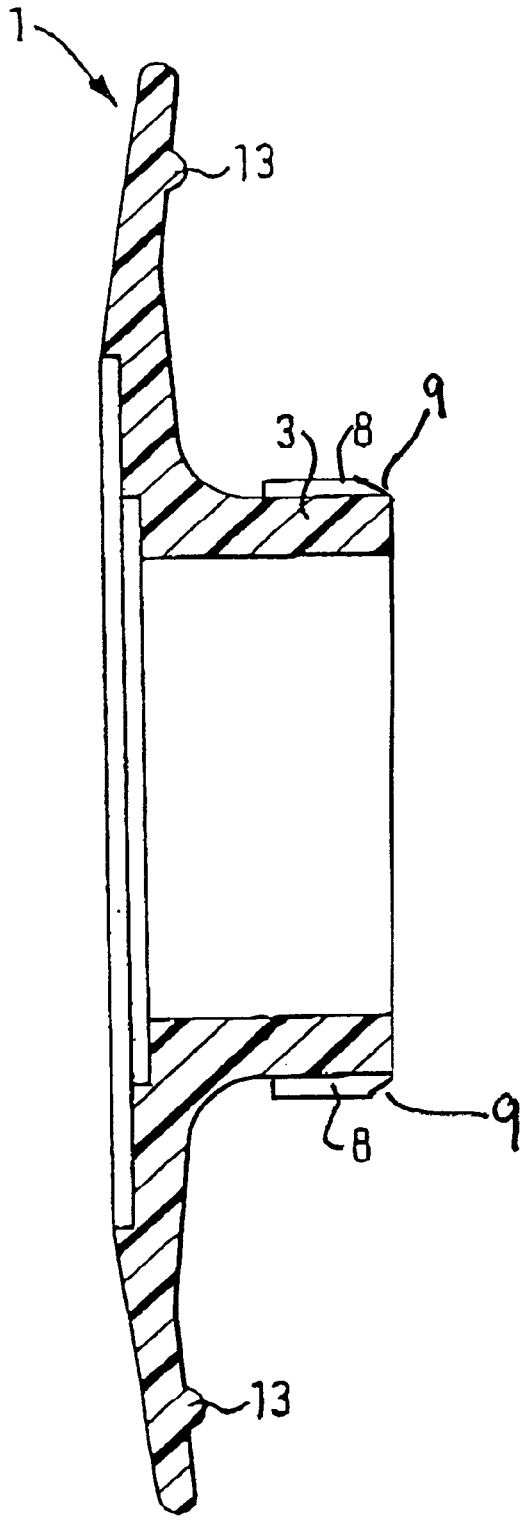
FIG. 4 is a modification of the disk of FIG. 1 wherein the axial collar has the same length as the axial collar of FIG. 2.

As indicated in detail by FIGS. 1 and in one embodiment the design is such that axial collar 3 of clamping disk 1 has a greater length than axial collar 4 of clamping disk 2 and its diameter is smaller, i.e. it reaches on its outside circumferential surface at most the diameter of the inside circumferential surface of axial collar 4 of clamping disk 2. In the embodiment of FIG. 4, the axial collar 3 of clamping disk 1 is the same length as the length of the axial collar 4 of clamping disk 2 of FIG. 2.

In the shown embodiment, the engaging connection between axial collars 3, 4 of clamping disks 1, 2 is obtained by a fitting or clamping joint in that smaller-diameter axial collar 3 of clamping disk 1 has on its outside circumferential surface a plurality of axial ribs 8—in the shown embodiment two axial ribs 8—spaced the same circumferential distance apart. The presence of axial ribs 8 thus produces the effect that axial collar 3 of clamping disk 1 has on its outside circumferential surface altogether a greater diameter than axial collar 4 of other clamping disk 2 on its inside circumferential surface. One thus obtains an effective fitting or clamping joint when clamping disks 1, 2 are joined and fastened together by collar 3 being pressed into collar 4.

In order to facilitate this pressing, axial ribs 8 are beveled on their front free face 9.

For the same purpose, axial collar 4 of other clamping disk 2 receiving axial ribs 8 of axial collar 3 is also beveled on its front face 10.

To secure the good fitting or clamping joint obtained when clamping disks 1, 2 are fixed together, greater-diameter axial collar 4 has at its front end torus 11 which grasps behind axial ribs 8 of axial collar 3 in securing fashion when clamping disks 1, 2 are fixed together. For this purpose axial ribs 8 in the embodiment of FIG. 1 are formed with an accordingly great predetermined length so as to secure the back-grasping function. This is especially clear from FIG. 3.

For nonslip mounting of brush fitting 5, greater-diameter axial collar 4 of clamping disk 2 bears on its outside circumference axially extending longitudinal ribs 12. For example, eight longitudinal ribs 12 are spaced the same circumferential distance apart, which ensures reliable and nonslip mounting of the brush fitting.

The same purpose is served by point-shaped projections 13 disposed numerously on the mutually facing inside surfaces of clamping disks 1, 2.

Clamping disks 1, 2 are made of glass fiber reinforced plastic and can advantageously be shaped as injection molded parts.

Figure 3:
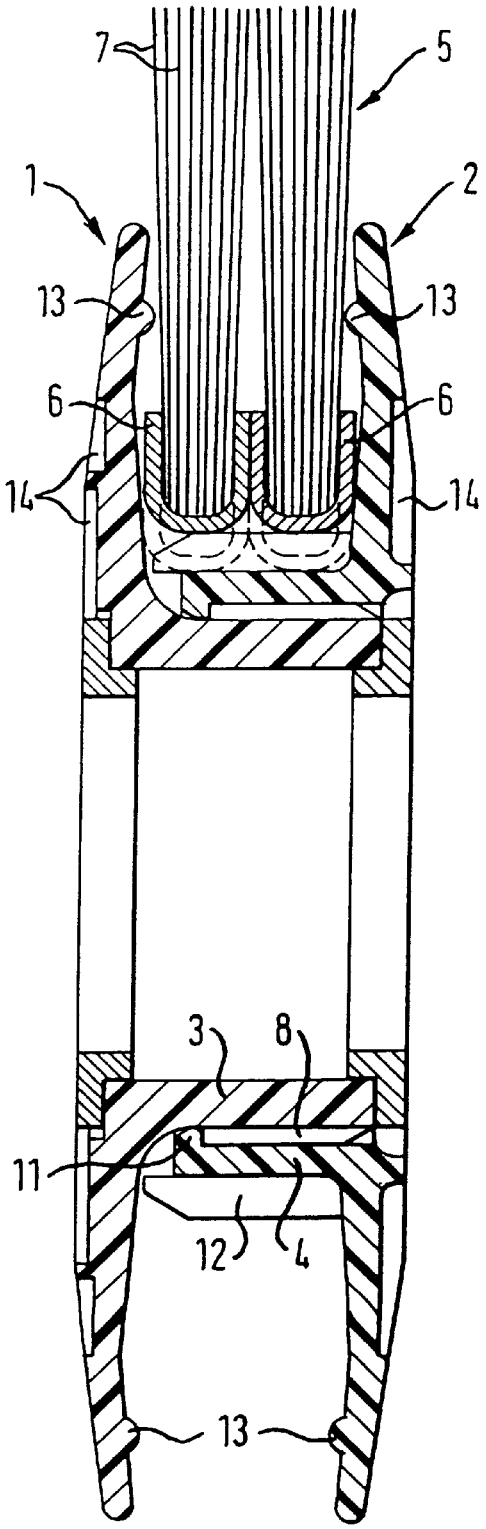
FIG. 3 is a cross sectional view of the rotary brush with the two clamping disks in the fixed state.

As is also clear from FIG. 3, clamping disks 1, 2 bear on their outside surface predetermined depressions 14 which are intended as labeling and marking surfaces.

Although the described embodiment is fundamentally conceived as an undetachable connection of clamping disks 1, 2 it is of course also possible, if desired, to design the connection between clamping disks 1, 2 so as to be subsequently detached, for example using a suitable tool for undoing the described securing of the connection.

With respect to features of the invention not specified above, reference is expressly made to the claims and drawing.

What is claimed is:

1. A rotary brush for surface treatment of workpiece comprising a brush fitting clamped between two interconnected clamping disks and mounted on an essentially cylindrical holding element formed thereby, the two clamping disks each having on their mutually facing sides an axial collar having outside or inside diameter such that when the clamping disks are fastened together the axial collar of one clamping disk engages the axial collar of the other clamping disk in connecting fashion so as to form the clamping disk connection to simultaneously form the cylindrical holding element for mounting the brush fitting, the engaging connection between the axial collars of the two clamping disks being formed by a fitting or clamping joint, the fitting or clamping joint between the axial collars being formed by at least one of the axial collars having elevations, in the form of axial ribs on its circumferential surface cooperating with the axial collar.

2. The brush of claim 1, wherein the axial collars of the two clamping disks have the same length.

3. The brush of claim 1, wherein the axial collars of the two clamping disks have different lengths.

4. The brush of claim 1, wherein the engaging connection between the axial collars of the two clamping disks is a detachable connection.

5. The brush of claim 1, wherein the engaging correction between the axial collars of the two clamping disks is formed or secured by adhesive applied to at least one of the cooperating circumferential surfaces of the axial collars.

6. The brush of claim 1, wherein one of the axial collars has a small diameter than another axial collar and the axial ribs are on the outside circumferential surface of the smaller-diameter axial collar.

7. The brush of claim 1, wherein at least two axial ribs are provided.

8. The brush of claim 1, wherein the axial ribs are spaced the same circumferential distance apart.

9. The brush of claim 1, wherein the axial ribs are beveled on front free faces thereof.

10. The brush of claim 1, wherein the axial collar receiving the axial ribs of the other axial collar is beveled on a front face thereof.

11. The brush of claim 1, wherein the axial collar receiving the axial ribs bears at its front end a torus which grasps behind the axial ribs with predetermined length of the other axial collar in securing fashion when the clamping disks are fixed together.

12. The brush of claim 1, wherein one of the greater-diameter axial collar bears on its outside circumferential surface axially extending longitudinal ribs for nonslip mounting of the brush fitting.

13. The brush of claim 1, wherein the clamping disks are made of glass fiber reinforced plastic.

14. The brush of claim 1, wherein the clamping disks are injection molded parts.

* * * * *